US005627520A

United States Patent [19]

Grubbs et al.

[11] Patent Number: 5,627,520

[45] Date of Patent: May 6, 1997

[54] TAMPER DETECT MONITORING DEVICE

[75] Inventors: Christopher A. Grubbs, New Braunfels; Matthew W. Ip, Austin, both of Tex.

[73] Assignee: ProTell Systems International, Inc., New Braunfels, Tex.

[21] Appl. No.: 500,270

[22] Filed: Jul. 10, 1995

[51] Int. Cl.[6] ..... G08B 13/14

[52] U.S. Cl. ..... 340/572; 340/539; 340/693; 455/100

[58] Field of Search ..... 340/573, 572, 340/539, 687, 693; 455/100; 200/61.41; 379/38, 40

[56] References Cited

U.S. PATENT DOCUMENTS

| | | | |
|---|---|---|---|
| 3,478,344 | 11/1969 | Schwitzgebel et al. | 340/539 X |
| 4,598,272 | 7/1986 | Cox | 340/539 |
| 4,694,284 | 9/1987 | Leveille et al. | 340/574 |
| 4,736,196 | 4/1988 | McMahon et al. | 340/573 |
| 4,812,823 | 3/1989 | Dickerson | 340/572 |
| 4,973,944 | 11/1990 | Maletta | 340/568 |
| 4,980,671 | 12/1990 | McCurdy | 340/568 |
| 4,999,613 | 3/1991 | Williamson et al. | 340/573 |
| 5,032,823 | 7/1991 | Bower et al. | 340/568 |
| 5,117,222 | 5/1992 | McCurdy et al. | 340/573 |
| 5,189,395 | 2/1993 | Mitchell | 340/539 |
| 5,218,344 | 6/1993 | Ricketts | 340/573 |
| 5,235,319 | 8/1993 | Hill et al. | 340/573 |
| 5,255,306 | 10/1993 | Melton et al. | 379/38 |
| 5,523,740 | 6/1996 | Burgmann | 340/573 |

*Primary Examiner*—Thomas Mullen

*Attorney, Agent, or Firm*—Gunn, Lee & Miller, P.C.

[57] ABSTRACT

An improved device for monitoring the presence of a person, animal or piece of property within a predefined space. The invention consists of a means for attaching to a monitoree, a transmitter assembly containing electronic circuitry which periodically sends a coded signal a limited distance to a remote detection unit. If the expected signal is not received, indicating that the person or object has been removed from the predefined space, an alarm condition is indicated. The transmitter is securely attached to the item being monitored by means of a non-stretchable, flexible, circuit strap which indicates an alarm condition when the strap is tampered with. The strap is locked into the transmitter assembly by a latch key which also triggers the transmitter to begin sending signals. The device is easily reattached or transferred to another item to be monitored by monitoring personnel by removing the latch key and inserting a new latch key after the device has been reinstalled.

18 Claims, 5 Drawing Sheets

TAMPER DETECT MONITORING DEVICE

BACKGROUND OF THE INVENTION

1. Field of the Invention

The present invention relates to an improved electronic tagging device for use in a monitoring system designed to indicate an alarm condition when a monitored object or person leaves a predefined area, or when the transmitter housing or strap has been tampered with or removed. The tamper detect monitoring system includes an electronic transmitter, housed in the device, which is attached to the person or equipment being monitored and an alarm notification base unit which indicates an alarm condition whenever the transmitter is removed from within a predefined space around the base unit. The transmitter sends an alarm condition indicating a tamper if the attaching strap is cut. The present invention relates specifically to an improved means for attaching and securing the tagging device, for effecting its activation, and for ensuring that a tamper event is detected while reducing false tamper indications. The device retains physical evidence of the tamper event which may be used in a court of law.

2. Description of the Related Art

Electronic monitoring devices are known in the art. Most employ an electronic transmitter which emits a radio signal and is securely fastened to the monitored person or item. The transmitter or "tag" can transmit its signal only over a limited range. The signal receiver is housed in a base unit located within the confinement area of the item or person. When the base unit does not receive a transmitted signal from the tag, an alarm condition is indicated. A signal is relayed to a remote station which may be a centralized monitoring station, an in-house monitoring station, or a hand-carried monitoring and tracking device. One example of this basic configuration is disclosed in U.S. Pat. No. 4,598,272 to Cox.

Various means of attaching the tag to the monitoree exist: U.S. Pat. No. 4,694,284, issued to Leville et al., discloses a hinged collar; U.S. Pat. No. 4,973,944, issued to Maletta describes a transmitter attached via a wrist band. By far, the most common method of attachment employs a strap which can be wrapped around and securely attached to an appendage of the monitoree. One such strap is disclosed in U.S. Pat. No. 4,812,823 issued to Dickerson.

The prior art also describes various methods for relaying an alarm condition to monitoring personnel from the monitoree's remote location. One such method as disclosed in U.S. Pat. No. 4,980,671, issued to McCurdy, teaches connecting the base monitoring unit to a telephone network for placing a telephone call to monitoring personnel whenever an alarm condition is detected. U.S. Pat. No. 5,255,306, issued to Melton et al., makes use of a cellular based telephone system in order to contact the monitoring personnel. It is also known in the art for each transmitting tag to include information such as a unique identifier for the monitoree, an indication that the tag has been tampered with, etc., in the transmitted signal as disclosed in U.S. Pat. No. 5,189,395, issued to Mitchell. Whereas each of these prior art devices discloses one or more features commonly found on electronic monitoring devices (i.e., a strap arrangement for securing the transmitter to a person or a piece of property, an identifiable signal emitted by the transmitter under certain circumstances, alteration of the signal upon certain movement of the person or equipment or upon tampering with the device), electronic monitoring systems presently available are not without their problems. Many of the existing systems are fraught with errors in detecting the difference between a false tamper incident and an actual tamper event. Excessive false tamper incidents in many of the existing systems have resulted in tamper condition reports simply being ignored because no physical evidence of a tamper can be observed when monitoring personnel attempt to verify the false tamper.

Another problem in the current state of the art involves the method of the attachment of the tag to the monitoree. Most straps used in the current art to attach the transmitter to the monitoree must be cut to size for each individual monitoree resulting in many differently sized straps for each transmitter and correspondingly increasing their cost. The straps are made more complicated by using mechanical means for physically and electrically attaching the strap to the transmitter housing and the monitoree. The mechanical components are often exposed to the elements allowing opportunities for corrosion and intermittent electrical shorts which increase the number of tamper signal indications when no tamper event actually occurred. These mechanical components include rivets, spike connectors, metal-on-metal screws, screw plates and slide bar connectors.

Current attachment methods dramatically increase the cost of monitoring by constantly reporting false tampers which do not exist. Phone line usage costs are often incurred each time the transmitter signals the false tamper condition by causing the in-home monitoring unit to report to the monitoring center usually by long distance service or 800 number phone line service. There are additional costs incurred when monitoring personnel are dispatched to the location to investigate the cause of the tamper signal. The constant false tamper condition signals reduce the reliability of current devices while increasing the cost of using them. On the other hand, both proper and improper installation of these devices can create opportunities for undetected or cancelable tampers and situations where removal and replacement of the strap cannot be determined by physical inspection. This often causes monitoring personnel to conclude that the tamper condition was false when in fact it was an actual tamper event.

Additional problems in the current state of the art involve the method of activating the transmitter. Many devices require the use of additional expensive electronic activation equipment to enable the radio transmitter and the tamper circuitry. Several current systems use a simple magnet to perform this function. Such magnets are easy to obtain and are easily used to reset or clear a tamper event, thereby deceiving the authorities about an actual tamper.

Further problems in the current state of the art involve the type and structure of the material used to complete the tamper circuit. The entire strap is often made of a conductive material thereby making it possible to use a jumper wire at any point on the strap to maintain the integrity of the circuit while permitting the strap to be severed and removed undetected.

A further problem in the current state of the art is that many of the systems do not have field replaceable batteries. To replace the battery in these systems, the transmitter must be sent back to the factory. This incurs additional costs for shipping as well as delays in the use of the transmitter requiring costly back-up units.

The present invention provides an improved monitoring device which eliminates the exposed strap, mechanical attachment, components thereby eliminating the causes for many of the false tamper incidents. The strap of the present invention is easily attached to and removed from the monitoree by authorized personnel by means of a reusable, size-adjustable and field-replaceable flex circuit strap. No specialized installation tools are required. The strap of the present invention has tamper detection circuitry embedded between layers of poly material with several false circuits to confuse any attempts to jumper the strap and tamper with the system. An inexpensive, replaceable and custom designed latch key serves to both lock the strap in place and activate the transmitter. When the latch key is forcibly removed or cut by unauthorized personnel, it leaves clear and unrefutable physical evidence of a tamper event which can be used in a court of law. The device is equipped with field replaceable batteries which eliminate the need to ship it back to the factory to replace the batteries.

SUMMARY OF THE INVENTION

It is an object of the present invention to provide an improved device which is capable of signaling when a monitored person or item is no longer within a predefined space.

It is an additional object of the present invention to provide a monitoring device with improved tamper detection capabilities. When tampered with, the device will indicate a tamper event through both a transmitted signal and physical evidence.

It is a further object of the present invention to provide a tamper detection monitoring device which overcomes and eliminates current deficiencies in strap connection and tamper circuitry technologies.

It is an additional object of the present invention to reduce the occurrence of false tamper signals by eliminating exposed metal-on-metal strap connections.

Yet another object of the present invention is to provide a field replaceable, reusable strap adjustable to a number of sizes without destruction of the strap and to provide a strap which significantly reduces the possibility of removing the strap without creating a tamper event.

Still another object of the present invention is to eliminate the need to use specialized tools to install the device by using an easily replaceable and inexpensive latch key and locking mechanism.

It is a further object of the present invention to provide access to the device by authorized persons so as to replace the device battery in the field.

It is a further object of the present invention to provide inexpensive activation equipment to enable the radio transmitter and tamper circuitry of the device.

The foregoing and other objects and advantages are attained by the device of the present invention which has practical application in a number of situations. The device of the present invention is initially applicable to a personnel monitoring system such as that used in an electronic house arrest monitoring (EHAM) program, wherein individuals who wear a special "tag" can be electronically monitored for compliance with a court-ordered sentence or similar restriction requiring them to remain at a specified location. The device of the present invention has other applications as well. The device is equally suited to monitoring other personnel, such as children at school or in a day-care, or patients in a nursing home or a hospital. Finally, the device may be used to monitor animals or equipment within a defined space.

The invention consists of an improved means for attaching to a person or object a transmitter assembly which houses electronic circuitry that periodically sends a coded signal a limited distance to a remote detection unit. If the expected signal is not received, indicating that the person or object has been removed from the predefined space, an alarm condition is indicated. The transmitter assembly is securely attached to the item being monitored by means of a non-stretchable, flexible strap with conductive tamper circuitry embedded between layers of poly material. The transmitter sends a tamper alarm signal when the strap is tampered with or cut. The flex circuit strap is locked into the transmitter assembly by an activation and locking latch key which depresses a strap locking arm into place and which triggers the transmitter to begin sending its signals. The device is easily reattached or transferred to another item or person to be monitored by monitoring personnel by cutting and removing the latch key and inserting a new latch key after the device has been attached.

DESCRIPTION OF THE PREFERRED EMBODIMENT

As generally described above, the device of the present invention has practical application in a number of situations. The device may be used to monitor the presence of a person, animal, or object within a predefined space. The invention described may be used in large institutions such as prisons, hospitals, or schools where it is necessary to monitor the location of individuals therein. The invention is not limited to institutional use, and will most likely be used to monitor a single individual such as a parolee confined to his home or some other predefined space.

Figure 1:
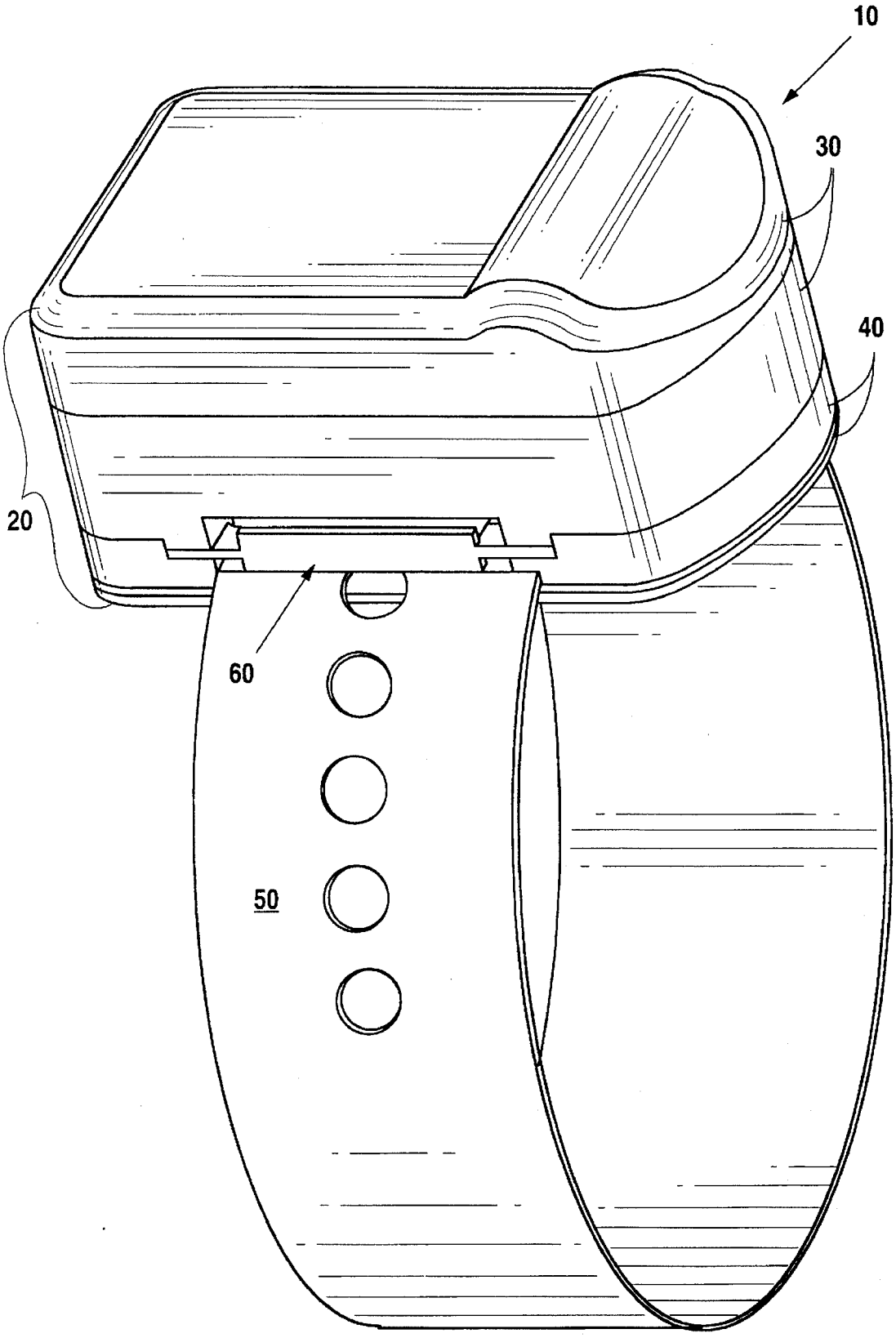
FIG. 1 is a perspective view of a preferred embodiment of the electronic tagging device of the present invention shown with the replaceable latch key locked into position for activation of the device.

Reference is made, therefore, to FIG. 1 for a description of a preferred embodiment of the current invention. FIG. 1 shows a perspective view of a preferred embodiment of an electronic tagging device (10) for use in conjunction with a remote detection unit (not shown) in a position monitoring system. In general, the tagging device (10) is composed of four components: a water-tight transmitter housing (30), a flex circuit strap locking system (40), a flex circuit strap (50), and an activation and locking latch key (60). The transmitter housing (30) and strap locking system (40) together make up the transmitter assembly (20). The transmitter housing (30) encases the electronic transmitter and circuitry (not shown) which emit, as is conventional, a coded signal detectable by the remote detection unit in the position monitoring system. The device (10) provides points for securely attaching the flex circuit strap (50) to the flex circuit strap locking system (40) after placing the flex circuit strap (50) around some part of the person or item to be monitored. The latch key (60) is inserted between the transmitter housing (30) and the flex circuit strap locking system (40) after the flex circuit strap (50) has been appropriately positioned. The latch key (60) serves a dual purpose of securing the second end of the flex circuit strap (50) in the strap locking system (40) as well as activating the transmitter circuitry within the transmitter housing (30) which broadcasts the signals emitted from the device (10).

Figure 2A:
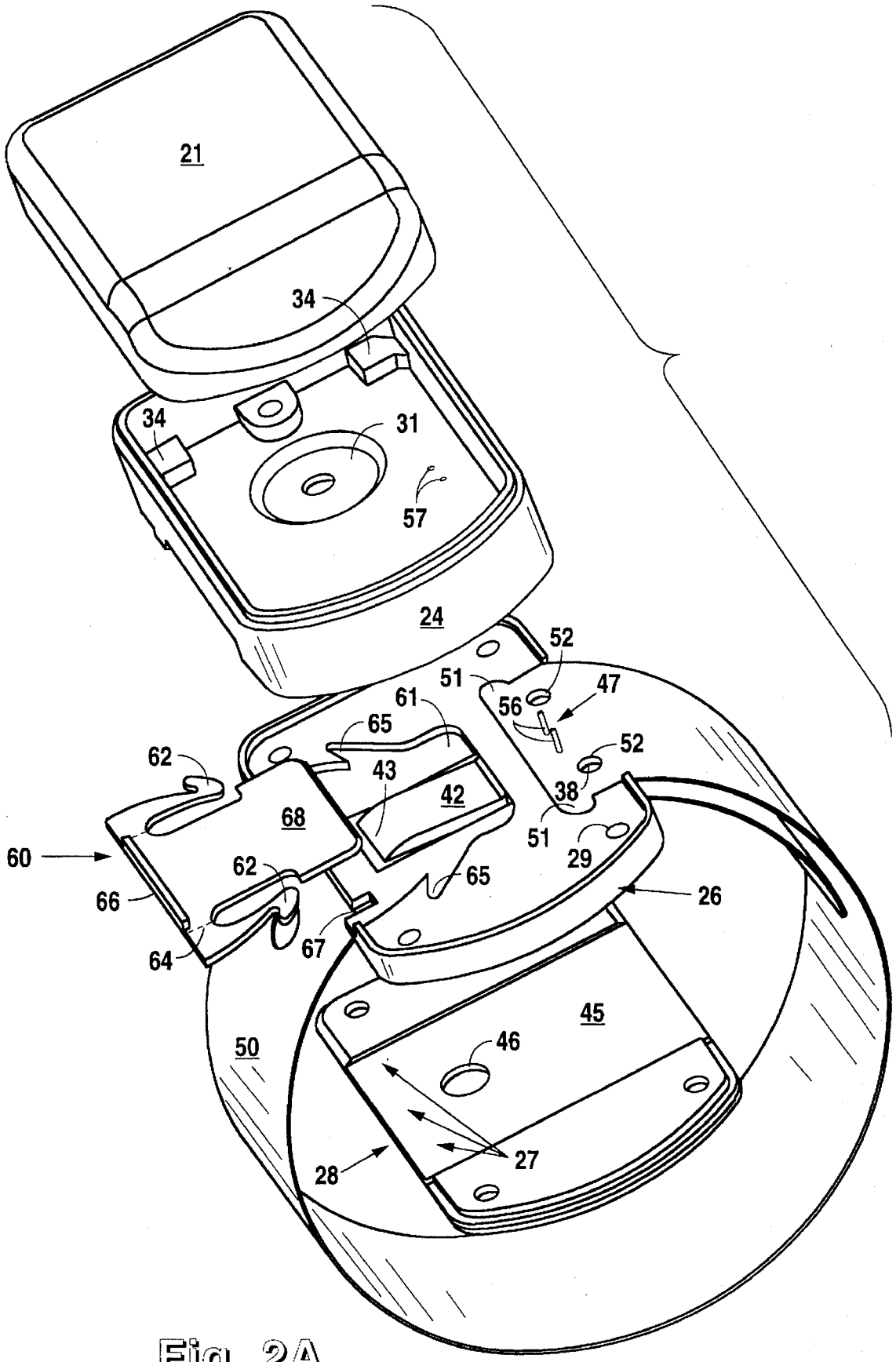
FIG. 2A is an exploded perspective view of the device of the present invention, showing a first side of each of the components.
Figure 2B:
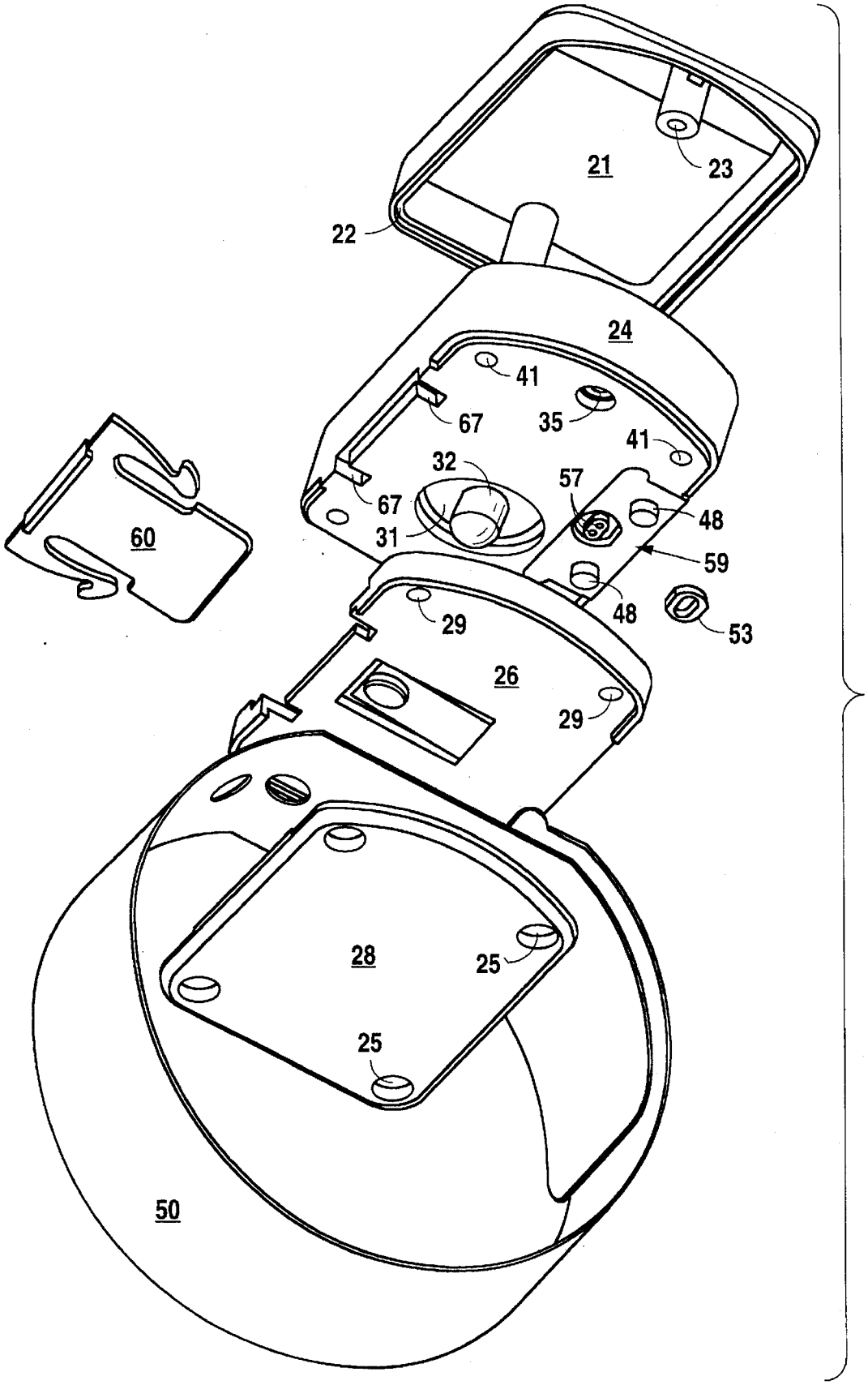
FIG. 2B is an exploded perspective view of the device of the present invention, showing a reverse side of each of the components.

FIGS. 2A and 2B depict exploded views of the transmitter housing (30) and strap locking system (40) of the present invention. The transmitter housing (30) holds the electronic transmitter circuitry (not shown) which is capable of emitting signals which are then sensed by a remote detection unit in the position monitoring system. The type of signal produced by the electronic circuitry may be any of a number commonly employed in the art, such as radio signals, infrared light, or other types of electromagnetic energy. The only requirement is that the signal be detectable by a remote detection unit. The transmitter circuitry is configured to emit its signal within a limited radius around the transmitter housing (30) thereby insuring that the wearer of the tagging device (10) remains within a predefined distance of the remote detection unit. Once the transmitter signal is no longer received by the detection unit, an out-of-range alarm condition is indicated by the remote detection unit and monitoring personnel are notified.

In the preferred embodiment, a signal frequency range between 315 to 320 MHz is utilized and the signal has an effective transmission range of 250 to 2,000 feet. The transmitter circuitry emits a signal each minute for the remote detection unit to analyze. Such transmissions may include data ranging from low battery detection, device tamper detection, and out-of-range and back-in-range detection. Diagnostic signals may be randomly transmitted to the receiver unit allowing for detection of discrepancies in previous data sent. Priority alarm signals may be transmitted at the time the alarm condition occurs while diagnostic signals are transmitted only at regular intervals.

The transmitter circuitry includes tamper circuitry which is configured to emit a coded signal immediately upon the occurrence of a flex circuit strap tamper thereby discouraging the wearer of the device (10) from removing it. Once a strap tamper event has occurred, a tamper alarm condition is indicated and monitoring personnel are notified. The transmitter housing (30) and the strap locking system (40) are configured and assembled so as to allow the device circuitry to be activated upon insertion of the latch key (60). Thus, the device (10) also indicates an alarm condition when the wearer loosens or separates the transmitter housing (30) or strap locking system (40) since such tampering will cause the transmitter to lose power and cease its transmissions resulting in an out-of-range alarm condition.

The transmitter housing (30) consists of a top cover (21) connected to a PC (primed circuit) board housing (24). The PC board housing (24) has an upper surface located closer to the top cover (21) and a lower surface on the opposite side of the PC board housing (24) from the top cover (21). The PC board housing (24) contains the electronic PC board (not shown) for the device circuitry adjacent to its upper surface. The PC board rests on the circuit board mounting platforms (34) and is attached to the PC board housing (24) by means of two in-board gasketed screws (not shown) which are used throughout the device (10) and are inserted through the PC board screw guide mounting points (35). The top cover (21) is secured to the PC board housing (24) by continuing the screws into the top cover screw retainers (23). In order to provide added security, the transmitter housing (30) is designed so that the screws cannot be accessed unless the strap locking system (40) has been disassembled. Since this can only occur if the strap (50) has been removed from the wearer, accessing the screws will create an alarm condition unless it is performed by authorized personnel.

A top cover gasket (22) provides a waterproof seal between the top cover (21) and the PC board housing (24) to protect the electronic circuitry of the transmitter and the circuitry battery (not shown) from outside elements. In the preferred embodiment, field replacement of the battery requires removal of the strap locking system (40) in order to obtain access to the in-board gasketed screws to permit removal of the top cover (21), thereby exposing the battery for replacement. This avoids having to ship the device (10) back to the factory for battery replacement.

The strap locking system (40) is composed of the PC board housing (24), the locking plate (26), and the base plate (28). Four gasketed mounting screws (not shown) hold the three pieces together through four base plate screw mounting access holes (25) in the base plate (28) and extend through four locking plate screw mounting access holes (29) to four PC board housing screw connector points (41) on the lower surface of the PC board housing (24). A first passage (47) is defined by the lower surface of the PC board housing (24) and the upper surface of the locking plate (26). It is within this first passage (47) that one end of the flex circuit strap (50) is connected to the strap locking system (40). The first passage (47) opens into a channel located on the lower surface of the PC board housing (24) and referred to as the strap mounting base guide (59) into which one end of the strap (50) fits. The strap mounting base guide (59) contains two strap mounting pegs (48) on which one end of the flex circuit strap (50) is mounted. The strap mounting pegs (48) are inserted through two corresponding mounting apertures (52) located at one end of the strap (50) and then into two aligned strap mounting retainers (38) located in locking plate (26). The strap (50) contains strap mounting tabs (51) designed to fit into carved out recesses within the strap mounting base guide (59). This further secures the strap (50) within the strap locking system (40).

Also located in the strap mounting base guide (59) is a strap tamper circuit pin connection guide (57) containing two apertures. It is through these two apertures that the tamper circuit connection pins (56) located at the end of the strap (50) between the mounting apertures (52) are inserted to make electrical connection with the transmitter circuitry located inside the transmitter housing (30). The tamper circuit pin connection guide (57) is surrounded by a deeper recess into which the strap pin gasket (53) is inserted to prevent leakage of outside elements into the transmitter housing (30) through the first passage (47). Also located on the lower surface of the PC board housing (24) is another recess which houses the switch diaphragm (31). In the preferred embodiment, the recess and diaphragm (31) are centrally located within the PC board housing (24). The diaphragm (31) contains a mechanical flex switch (32) which protrudes out of the recess and below the lower surface of the PC board housing (24). When the latch key (60) presses against the mechanical flex switch (32), pressure is applied to the diaphragm (31) and the electronic circuitry is activated. The mechanical flex switch (32) behaves like a "living switch" in that it flexes when the latch key (60) is inserted against it and returns to its initial position when the latch key (60) is removed. Thus, the activation of the transmitter circuitry is internal to the device (10). Tampering with the device (10) or removing the latch key (60) releases the mechanical flex switch (32) causing the transmitter circuitry to lose electrical power. This loss of power prevents transmission of the device signals to the receiving unit and results in an alarm condition. Tampering with the device housing such as by prying it apart will similarly release the mechanical flex switch (32) and produce an alarm condition. The diaphragm (31) also serves to isolate the electronic transmitter circuitry from wear and damage by water and dust which might otherwise seep in.

Also located in the strap locking system (40) is a latch guide channel (61) formed by a recess in the locking plate (26). In the preferred embodiment, the first passage (47) and the latch guide channel (61) lie on opposite sides of the strap locking system (40). However, their location can be anywhere in the strap locking system (40) such that both ends of the strap (50) may be secured to the strap locking system (40) after being wrapped around some part of the person or item to be monitored. In the preferred embodiment, the latch guide channel (61) is located opposite the first passage (47), yet still between the PC board housing (24) and the locking plate (26). It is into the latch guide channel (61) that the latch key (60) is inserted, thereby activating the transmitter circuitry. The latch guide channel (61) includes two latch locking retainers (65) into which two locking tabs (62) on the latch key (60) fit to hold the latch key (60) within the strap locking system (40).

The latch guide channel (61) also contains two latch removal cut-outs (67). These cut-outs (67) provide access for cutting the locking tabs (62) on the latch key (60) along the latch cutting section (64) allowing for authorized removal of the latch key (60) and subsequent removal of the strap (50) from the person or item being monitored. Forcibly removing the latch key (60) will deactivate the transmitter circuitry thereby causing an alarm. Forcible removal also breaks the locking tabs (62) from the latch key (60) providing physical evidence of a tamper event which can be used in a court of law.

The latch key (60) also contains a ridge (66) which serves as a pressure point for securely snapping the latch key (60) into place within the latch guide channel (61). Once inserted, the latch key (60) has a main body (68) which serves two functions. As described above, it is this main body (68) which presses against the protruding mechanical flex switch (32) of the switch diaphragm (31) so as to activate the transmitter circuitry. The main body (68) also contacts the strap locking arm (42) located in the locking plate (26) to lock the second end of the strap (50) within the strap locking system (40). When the latch key (60) is inserted into the latch guide channel (61), the main body (68) initially contacts the strap locking arm (42) at a latch contact deflector (43) at the free end of the strap locking arm (42). As the latch key (60) is further inserted into the latch guide channel (61), the strap locking arm (42) is forced downward through the locking plate (26), securing the second end of the strap (50) within the locking system (40) as further described below.

A second passage (45) is located between the locking plate (26) and the base plate (28). The second passage (45) is formed by the strap guide (27), a channel in the base plate (28). In the preferred embodiment, the second passage (45) extends through the entire strap locking system (40) and allows the excess length of the second end of the strap (50) to protrude from the strap locking system (40) as the strap (50) is tightened to secure it around the person or item to be monitored. It is this second end of the strap (50) which is the adjustable end. Preferably, the second passage (45) is in parallel spaced relation to the latch guide channel (61). Insertion of the loose end of the flex circuit strap (50) into the second passage (45) combined with insertion of the latch key (60) into the latch guide channel (61) will both lock the strap (50) into place and activate the transmitter circuitry housed in the PC board housing (24) by contacting the mechanical flex switch (32) in order to deflect the switch diaphragm (31) upward.

Figure 3A:
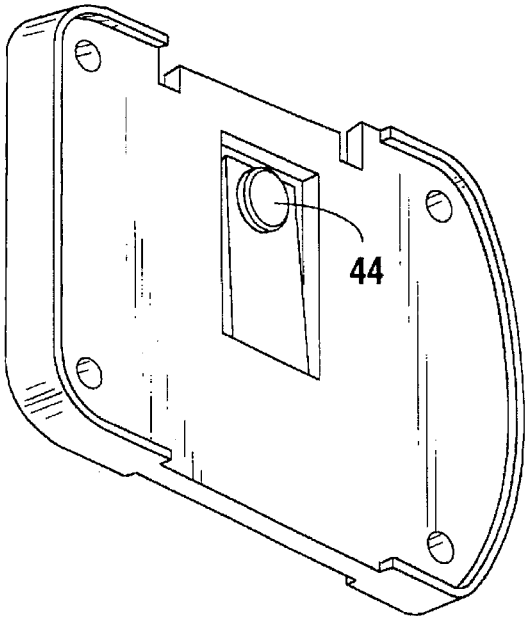
FIG. 3A is a perspective view of the reverse side of the locking plate.
Figure 3B:
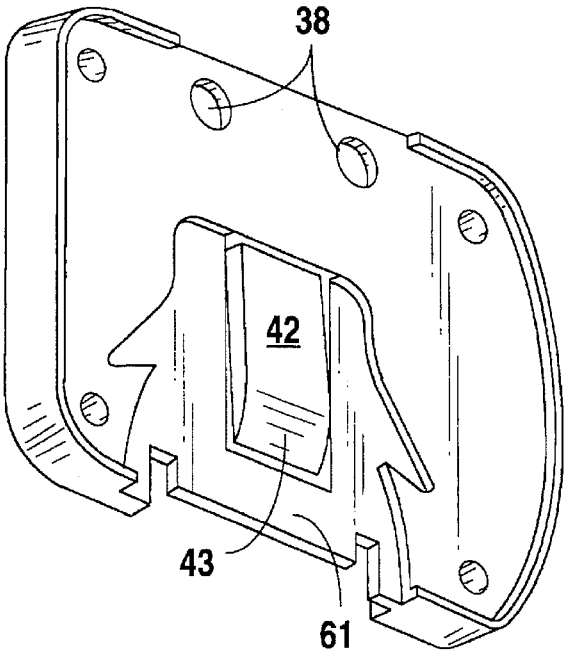
FIG. 3B is a perspective view of the first side of the locking plate shown in FIG. 3A.
Figure 4:
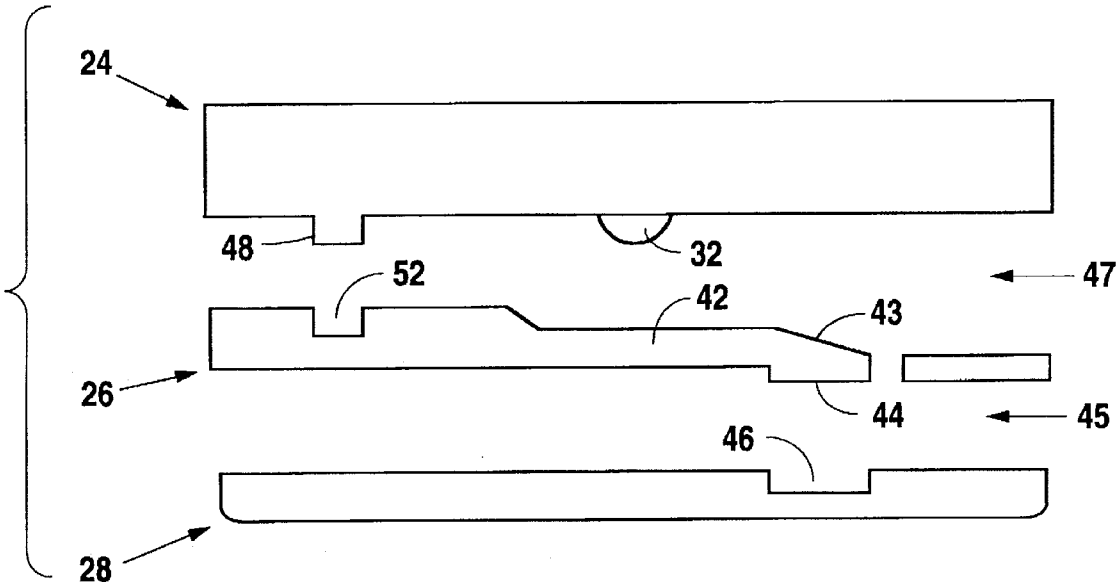
FIG. 4 is an exploded end view of the PC board housing, the locking plate, and the base plate of the present invention.

Referring now to FIGS. 3A, 3B, and 4, insertion of the latch key (60) into the latch guide channel (61) activates a strap locking arm (42) to hold the strap (50) at any number of preselected lengths as mentioned above. This is accomplished by the latch key (60) contacting a wedge-shaped latch contact deflector (43) on the resilient locking arm (42) which is located on the locking plate (26). At the free end of the strap locking arm (42) is a strap locking plunger (44) which extends perpendicular to the surface of the strap locking arm (42) and is located on the side of the strap locking arm (42) closest to the base plate (28). The locking plunger (44) is displaced through one of the size-adjustment apertures (described in more detail below) located in the strap (50) and into the strap locking plunger retainer (46) located in the base plate (28). In the preferred embodiment, the locking plunger (44) fits through the strap aperture and into the plunger retainer (46) to an exact measurement so as to minimize the amount of play in the length of the strap once it is attached. The strap (50) is thus held at a specific length until such time as the latch key (60) is removed from the latch guide channel (61) releasing the strap locking arm (42) to unlock the strap (50).

Removal of the device (10) from the object or person being monitored may be readily accomplished as follows. First, the latch key (60) must be removed from the latch guide channel (61) by cutting the locking tabs (62) on the latch key (60). Removal of the latch key (60) deactivates the transmitter circuitry by releasing pressure on the diaphragm (31). Because the transmitter stops sending its signal, an alarm condition results. If the latch key removal was performed by authorized personnel, the alarm condition will be expected and may be ignored; otherwise, the cause of the alarm will be investigated.

Removal of the latch key (60) also causes the locking arm (42) to return to its original position thereby releasing the strap locking plunger (44) from the strap locking plunger retainer (46) and the corresponding size-adjustment aperture located in the strap (50). The second end of the strap (50) may then be removed from the second passage (45) of the strap locking system (40), and the device (10) removed from the monitored object without having destroyed the strap (50). When thus removed, the device (10) may be easily reattached to the same object or attached to a new object to be monitored while keeping the expensive strap (50) intact and destroying only the inexpensive latch key (60).

Figure 5A:
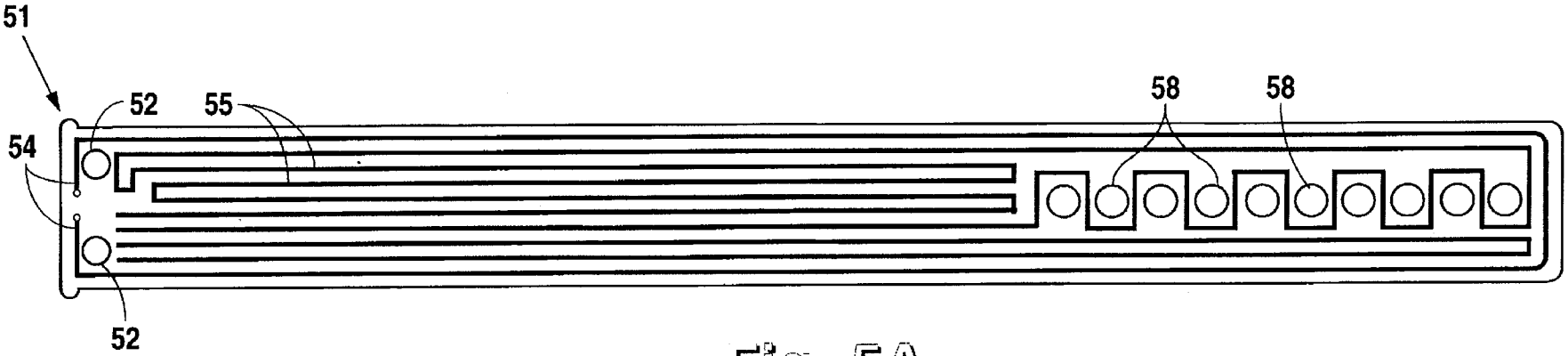
FIG. 5A is a top view of the strap of the electronic tagging device of the present invention.
Figure 5B:
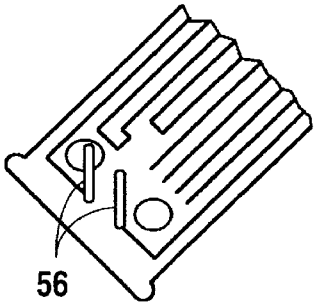
FIG. 5B is a detail perspective view of one end of the strap shown in FIG. 5A.

FIGS. 5A and 5B depict the structure of the flex circuit strap (50) of the preferred embodiment of the present invention. The strap (50) is composed of layers of flexible composite material sealed together which allow it to be wrapped around an appendage or other protrusion from the person or item to be monitored but which prevent the strap from stretching. Further, the strap (50) contains an electrically conductive circuit (54) which is sandwiched between the layers of composite materials such that if the strap (50) is severed due to tampering or an attempt to remove the device (10), an open circuit through the strap (50) will exist. This condition is detectable by the electronic circuitry within the PC board housing (24), and an appropriate alarm condition is then relayed to the monitoring personnel. Additional false circuitry (55) is aligned with the active conductive circuit (54) in an effort to confuse any attempt to tamper with the strap by means of a jumper wire.

The first end of the strap (50) is semi-permanently mounted within the strap locking system (40) of the device (10) as described above. In the preferred embodiment, this is accomplished during the assembly stage of the device (10) by placing the strap mounting pegs (48) located in the first passage (47) (see FIG. 2B) through the two mounting apertures (52) located at the first end of the strap (50) near the strap mounting tabs (51). When the locking system (40) is assembled, the mounting pegs (48) permanently hold the first end of the strap (50) in the first passage (47).

As mentioned above, the strap (50) is electrically conductive. In the preferred embodiment, this electrical conductivity is achieved by a circuitous conductive circuit (54) located within the non-conductive material of the strap (50). The conductive circuit (54) terminates at two points defining a pair of electrical contact pins (56) located at the first end of the strap (50). When the first end of the strap (50) is placed within the first passage (47) of the locking system (40), the electrical contact pins (56) make physical and electrical connection with a matching set of electrical contacts through the pin connector guides (57) located in the first passage (47). The integrity of the waterproof transmitter housing (30) of the preferred embodiment is maintained through the use of a water-tight pin gasket (53) between the PC board housing (24) and the strap (50) in the vicinity of the pin connector guides (57). The electrical contacts (not shown) are electrically connected to the electronic circuitry within the PC board housing (24). Activation of the electronic circuitry causes an electrical current to pass through the conductive circuit (54) of the strap (50). The electronic circuitry of the present device (10) thus is able to sense when the conductive circuit (54) is broken due to a tamper event. When such a condition is detected, an appropriate tamper alarm condition is indicated to the monitoring personnel. The path of the conductive circuit (54) within the strap (50) is such that any tearing or cutting of the strap (50) necessary to forcibly remove the device (10) results in the breaking of the circuit causing the tamper alarm condition.

Located at the second end of the strap (50) are multiple size-adjustment apertures (58) which are in longitudinal spaced relation with the length of the strap (50) along its central axis. When mounting the device (10) on the person or item to be monitored, the strap (50) is wrapped around some part of the monitored object and the second end is inserted into the second passage (45) of the strap locking system (40). The strap (50) is then adjusted to form a relatively tight fit around the monitored object. Once the desired fit is achieved, the latch key (60) is inserted into the latch guide channel (61) thereby causing the strap locking plunger (44) to extend through the most appropriately positioned one of the size-adjustment apertures (58). The second end of the strap (50) is thus held at a fixed position, as long as latch key (60) is inserted, to ensure that removal of the device (10) does not go undetected.

It is intended that the above description of the preferred embodiment of the structure of the present invention is but one enabling best mode embodiment for implementing the invention. Other applications are likely to be conceived of by those skilled in the art, which applications still fall within the breadth and scope of the disclosure of the present invention. The primary import of the present invention lies in its improved ability to accurately detect when the device has been tampered with as well as the ease and reduced cost of removing and reattaching the device. Its benefits derive from the versatility of the application of the present invention and its reusability and accuracy. Again, it is understood that other applications of the present invention will be apparent to those skilled in the art upon a reading of the preferred embodiment and a consideration of the appended claims and drawings.

We claim:

1. An electronic tagging device for attachment to an object or person to be monitored, for use in conjunction with a remote detection unit in a position monitoring system, said electronic tagging device comprising:

a transmitter assembly comprising;

electronic circuitry capable of transmitting signals to said remote detection unit;

a transmitter housing enclosing said circuitry, said transmitter housing defining first and second passages and a latch guide channel;

a circuitry activating switch extending into said latch guide channel; and a flexible strap locking arm having a strap locking plunger and positioned between said latch guide channel and said second passage;

a strap for attachment to said object to be monitored, said strap having at a first end a set of connecting pins terminating a circuitous conductive circuit within said strap, and having at a second end multiple apertures formed in longitudinal spaced relation with the length of said strap, said first end of said strap configured for mechanical and electronic connection to said transmitter assembly via placement in said first passage, said set of connecting pins extending through pin connection guides positioned in said transmitter assembly to said electronic circuitry, said second end of said strap slidably insertable into said second passage; and a latch key slidably insertable into said latch guide channel such that insertion of said latch key activates said electronic circuitry by contact with said circuitry activating switch, and displaces said strap locking arm into said second passage through one of said apertures in said second end of said strap positioned therein, said strap locking plunger holding said second end of said strap within said transmitter assembly.

2. The tamper detection monitoring device of claim 1, wherein said latch key securely locks into said latch guide channel once completely inserted therein.

3. The tamper detection monitoring device of claim 2, wherein said latch key has two latch locking tabs on opposite sides of said latch key which fit into dual latch locking retainers in said transmitter assembly.

4. The tamper detection monitoring device of claim 1, wherein said transmitter assembly is waterproof.

5. An electronic tagging device for attachment to an object or person to be monitored, for use in conjunction with a remote detection unit in a position monitoring system, said electronic tagging device comprising:

a transmitter assembly comprising;

electronic circuitry capable of transmitting signals to said remote detection unit;

a transmitter housing enclosing said circuitry, said transmitter housing defining first and second passages and a latch guide channel;

a circuitry activating switch extending into said latch guide channel; and a flexible strap locking arm having a strap locking plunger and positioned between said latch guide channel and said second passage;

a strap for attachment to said object to be monitored, said strap having a first end configured for mechanical connection to said transmitter via placement in said first passage, and having at a second end a plurality of apertures formed in longitudinal spaced relation with the length of said strap, said second end of said strap slidably insertable into said second passage; and a latch key slidably insertable into said latch guide channel such that insertion of said latch key activates said electronic circuitry by contact with said circuitry activating switch, and displaces said strap locking arm into said second passage through one of said apertures in said second end of said strap positioned therein, said strap locking plunger holding said second end of said strap within said transmitter assembly.

6. An electronic tagging device for attachment to an object or person to be monitored, for use in conjunction with a remote detection unit in a position monitoring system, said electronic tagging device comprising:

a flex circuit strap having first and second ends, capable of being securely placed around said person or object, containing an electrically conductive circuit forming a circuitous path within said strap, said path terminating in a pair of electrical contact pins at said first end, and defining at said second end a plurality of size-adjustment apertures in longitudinal spaced relation along a central axis of said strap;

a transmitter assembly comprising;

electronic circuitry capable of detecting when said conductive circuit in said strap has been severed and emitting a signal detectable by said remote detection unit;

a power supply;

a transmitter housing comprising;

a top cover;

a PC board housing connected to said top cover, having an upper and lower surface, said PC board housing defining a strap mounting base guide adjacent said lower surface, having a plurality of strap mounting pegs for attachment of said first strap end and a strap tamper circuit pin connection guide designed to receive said pair of electrical contact pins, and housing a switch diaphragm having a mechanical flex switch protruding below said lower surface for activation and deactivation of said electronic circuitry;

a strap locking system comprising;

a locking plate connected to said PC board housing, defining with said PC board housing a first passage into which extend said plurality of strap mounting pegs, also defining a latch guide channel having a plurality of latch locking retainers and defining a plurality of latch removal cut-outs, and containing a flexible strap locking arm secured at a fixed end to said locking plate and having at its free end a latch contact deflector and a strap locking plunger;

a base plate connected to said locking plate having a strap guide channel which defines a second passage between said locking plate and said base plate for insertion of said second strap end, and further defining a strap locking plunger retainer for receipt of said strap locking plunger;

a latch key insertable into said latch guide channel having a main body for activation of said electronic circuitry through contact with said mechanical flex switch and for locking said second strap end securely within said strap locking system through contact with said strap locking arm so as to displace said strap locking plunger through one of said size-adjustment apertures and into said strap locking plunger retainer, said latch key having a plurality of locking tabs for engaging said latch locking retainers upon insertion of said latch key into said latch guide channel.

7. The electronic tagging device of claim 6, wherein said signal is electromagnetic energy.

8. The electronic tagging device of claim 6, wherein said signal is emitted over a limited distance around said device.

9. The electronic tagging device of claim 6, wherein said signal contains low battery, device tamper, out-of-range and back-in-range data.

10. The electronic tagging device of claim 6, wherein said signal further comprises a diagnostic signal used for detecting discrepancies in previous data sent.

11. The electronic tagging device of claim 6, wherein said signal is transmitted at regular intervals when containing diagnostic data and immediately when containing an alarm condition.

12. The electronic tagging device of claim 6, wherein said transmitter assembly further comprises a plurality of base plate screw mounting access holes located in said base plate, a plurality of locking plate screw mounting access holes in said locking plate, a plurality of PC board housing screw connector points located in said PC board housing, a plurality of gasketed mounting screws for insertion through one each of said base plate screw mounting access holes, one of said locking plate screws mounting access holes, and into one of said PC board housing screw connector points to hold said base plate, said locking plate and said PC board housing together.

13. The electronic tagging device of claim 6, wherein said latch guide channel lies opposite said first passage.

14. The electronic tagging device of claim 6, wherein said latch guide channel has two latch locking retainers and wherein said latch key has two locking tabs.

15. The electronic tagging device of claim 6, wherein said second passage extends through the entire strap locking system.

16. The electronic tagging device of claim 6, wherein said second passage lies in parallel spaced relation with said latch guide channel.

17. The electronic tagging device of claim 6, wherein said device has an effective transmission range from 250 to 2,000 feet.

18. The electronic tagging device of claim 6, wherein said strap contains additional false circuitry.

* * * * *